US009828811B2

(12) United States Patent
Patel et al.

(10) Patent No.: US 9,828,811 B2
(45) **Date of Patent: *Nov. 28, 2017**

(54) ROTATABLE CUTTING ELEMENTS AND RELATED EARTH-BORING TOOLS AND METHODS

(71) Applicant: Baker Hughes Incorporated, Houston, TX (US)

(72) Inventors: Suresh G. Patel, The Woodlands, TX (US); Bruce Stauffer, Spring, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/178,298

(22) Filed: Jun. 9, 2016

(65) Prior Publication Data

US 2016/0290058 A1 Oct. 6, 2016

Related U.S. Application Data

(63) Continuation of application No. 13/871,935, filed on Apr. 26, 2013, now Pat. No. 9,388,639.

(51) Int. Cl.
*E21B 10/42* (2006.01)
*E21B 10/573* (2006.01)
(Continued)

(52) U.S. Cl.
CPC ..... *E21B 10/62* (2013.01); *E21B 10/42* (2013.01); *E21B 10/567* (2013.01); *E21B 10/5735* (2013.01); *E21B 10/60* (2013.01)

(58) Field of Classification Search
CPC .. E21B 10/567; E21B 10/5673; E21B 10/573; E21B 10/42; E21B 10/52; E21B 10/55; E21B 10/62; E21B 10/5735
See application file for complete search history.

(56) References Cited

U.S. PATENT DOCUMENTS 4,553,615 A 11/1985 Grainger
4,606,418 A 8/1986 Thompson
(Continued)

FOREIGN PATENT DOCUMENTS

EP 811112 B1 5/2001
GB 2428709 A 2/2007
WO 2007044791 A1 4/2007

OTHER PUBLICATIONS

Smith Bits, A Schlumberger Company, Technology Development Bulletin—Rolling Cutter, Marketing & Technology, Apr. 2012, 3 pages.

(Continued)

*Primary Examiner* — Daniel P Stephenson
(74) *Attorney, Agent, or Firm* — TraskBritt

(57) ABSTRACT

Earth-boring tools may comprise rotatable cutting elements rotatably connected to protruding journals, which may be at least partially located within inner bores extending through the rotatable cutting elements. A rotationally leading end of one of the protruding journals may not extend beyond a cutting face of its associated rotatable cutting element. Alternatively, a protruding journal may comprise a chip breaker protruding from a cutting face of a rotatable cutting element. Methods of removing an earth formation may include directing cuttings forward, away from a cutting face of a rotatable cutting element when the cuttings reach an inner bore of the rotatable cutting element, and rotating the rotatable cutting element around a protruding journal at least partially located in the inner bore.

20 Claims, 6 Drawing Sheets

(51) Int. Cl.

| | |
|---|---|
| ***E21B 10/60*** | (2006.01) |
| ***E21B 10/62*** | (2006.01) |
| ***E21B 10/567*** | (2006.01) |

(56) References Cited

U.S. PATENT DOCUMENTS

| | | | |
|---|---|---|---|
| 4,654,947 | A | 4/1987 | Davis |
| 4,751,972 | A | 6/1988 | Jones et al. |
| 4,997,049 | A | 3/1991 | Tank et al. |
| 5,316,095 | A | 5/1994 | Tibbitts |
| 5,447,208 | A | 9/1995 | Lund et al. |
| 5,449,048 | A | 9/1995 | Thigpen et al. |
| 5,590,729 | A | 1/1997 | Cooley et al. |
| 5,653,300 | A | 8/1997 | Lund et al. |
| 5,706,906 | A | 1/1998 | Jurewicz et al. |
| 5,924,501 | A | 7/1999 | Tibbitts |
| 5,975,811 | A | 11/1999 | Briese et al. |
| 6,508,516 | B1 | 1/2003 | Kammerer |
| 6,527,065 | B1 | 3/2003 | Tibbitts et al. |
| 6,932,172 | B2 | 8/2005 | Dvorachek |
| 7,363,992 | B2 | 4/2008 | Stowe et al. |
| 7,703,559 | B2 | 4/2010 | Shen et al. |
| 8,091,655 | B2 | 1/2012 | Shen et al. |
| 8,210,285 | B2 | 7/2012 | Cooley et al. |
| 8,210,288 | B2 | 7/2012 | Chen et al. |
| 8,216,677 | B2 | 7/2012 | Mukhopadhyay et al. |
| 8,413,746 | B2 | 4/2013 | Shen et al. |
| 8,978,788 | B2 | 3/2015 | Vempati et al. |
| 8,991,523 | B2 | 3/2015 | Shen et al. |
| 9,303,461 | B2 | 4/2016 | Patel et al. |
| 9,322,219 | B2 * | 4/2016 | Burhan ..... E21B 10/46 |
| 9,388,639 | B2 * | 7/2016 | Patel ..... E21B 10/42 |
| 9,464,486 | B2 * | 10/2016 | Zhang ..... E21B 10/573 |
| 9,482,056 | B2 * | 11/2016 | Eyre ..... E21B 10/46 |
| 2002/0153175 | A1 | 10/2002 | Ojanen |
| 2003/0209366 | A1 | 11/2003 | McAlvain |
| 2004/0231894 | A1 | 11/2004 | Dvorachek |
| 2007/0278017 | A1 | 12/2007 | Shen et al. |
| 2008/0017419 | A1 | 1/2008 | Cooley et al. |
| 2008/0085407 | A1 | 4/2008 | Cooley et al. |
| 2008/0251293 | A1 | 10/2008 | Mumma et al. |
| 2008/0264696 | A1 | 10/2008 | Dourfaye et al. |
| 2010/0012388 | A1 | 1/2010 | Shamburger et al. |
| 2010/0084198 | A1 | 4/2010 | Durairajan et al. |
| 2010/0307829 | A1 | 12/2010 | Patel |
| 2011/0031031 | A1 | 2/2011 | Vempati et al. |
| 2011/0073379 | A1 | 3/2011 | DiGiovanni et al. |
| 2011/0259642 | A1 | 10/2011 | DiGiovanni et al. |
| 2013/0292185 | A1 | 11/2013 | Knull et al. |
| 2014/0318873 | A1 | 10/2014 | Patel et al. |

OTHER PUBLICATIONS

Smith Bits, A Schlumberger Company, Technology Development Bulletin—Rolling Cutter, Marketing & Technology, Oct. 2012, 7 pages.

Zijsling, D. H., Single Cutter Testing—A Key for PDC Bit Development, Society of Petroleum Engineers, SPE 16529/1 Offshore Europe Aberdeen, Sep. 8-11, 1987, 14 pages.

* cited by examiner

ROTATABLE CUTTING ELEMENTS AND RELATED EARTH-BORING TOOLS AND METHODS

CROSS-REFERENCE TO RELATED APPLICATIONS

This application is a continuation of U.S. patent application Ser. No. 13/871,935, filed Apr. 26, 2013, now U.S. Pat. No. 9,388,639, issued Jul. 12, 2016, and is related to the subject matter of U.S. patent application Ser. No. 13/661,917, filed Oct. 26, 2012, now U.S. Pat. No. 9,303,461, issued Apr. 5, 2016, for "CUTTING ELEMENTS HAVING CURVED OR ANNULAR CONFIGURATIONS FOR EARTH-BORING TOOLS, EARTH-BORING TOOLS INCLUDING SUCH CUTTING ELEMENTS, AND RELATED METHODS," the disclosure of each of which is incorporated herein in its entirety by this reference.

FIELD

The disclosure relates generally to rotatable cutting elements for earth-boring tools. More specifically, disclosed embodiments relate to rotatable cutting elements for earth-boring tools that may rotate to present a continuously sharp cutting edge.

BACKGROUND

Some earth-boring tools for forming boreholes in subterranean formations, such as, for example, fixed-cutter earth-boring rotary drill bits (also referred to as "drag bits") and reamers, include cutting elements secured to the rotationally leading portions of blades. The cutting elements are conventionally fixed in place, such as, for example, by brazing the cutting elements within pockets formed in the rotationally leading portions of the blades. When the cutting elements are fixed, only a portion of a cutting edge extending around a cutting face of each cutting element may actually engage with and remove earth material. Because earth removal exposes that portion of the cutting edge to highly abrasive material, it gradually wears away, which dulls that portion of the cutting edge and forms what is referred to in the art as a "wear flat." Continued use may wear away that portion of the cutting edge entirely, leaving a completely dull surface that is ineffective at removing earth material.

Some attempts have been made to induce each cutting element to rotate such that the entire cutting edge extending around each cutting element engages with and removes earth material. For example, U.S. Patent Application Pub. No. 2008/0017419, published Jan. 24, 2008, for "CUTTING ELEMENT APPARATUSES, DRILL BITS INCLUDING SAME, METHODS OF CUTTING, AND METHODS OF ROTATING A CUTTING ELEMENT," the disclosure of which is incorporated herein in its entirety by this reference, discloses rotatable cutting elements that are actively rotated using a cam assembly. As another example, U.S. Pat. No. 7,703,559, issued Apr. 27, 2010, for "ROLLING CUTTER," the disclosure of which is incorporated herein in its entirety by this reference, discloses cutting elements that are passively rotated within support elements that may be brazed to the blades of a drill bit.

BRIEF SUMMARY

In some embodiments, earth-boring tools comprise a body comprising blades extending radially outward to define a face at a leading end of the body. Each blade comprises protruding journals at a rotationally leading end of each blade. Rotatable cutting elements are rotatably connected to the protruding journals. One of the rotatable cutting elements comprises a substrate. A polycrystalline table is attached to the substrate. The polycrystalline table is located on an end of the substrate. An inner bore extends through the substrate and the polycrystalline table. One of the protruding journals is at least partially located within the inner bore. A rotationally leading end of the one of the protruding journals does not extend beyond a cutting face of the one of the rotatable cutting elements.

In other embodiments, earth-boring tools comprise a body comprising blades extending radially outward to define a face at a leading end of the body. Each blade comprises protruding journals at a rotationally leading end of each blade. Rotatable cutting elements are rotatably connected to the protruding journals. One of the rotatable cutting elements comprises a substrate. A polycrystalline table is attached to the substrate. The polycrystalline table is located on an end of the substrate. An inner bore extends through the substrate and the polycrystalline table. One of the protruding journals is at least partially located within the inner bore. The one of the protruding journals comprises a chip breaker protruding from a cutting face of the polycrystalline table.

In yet other embodiments, methods of removing earth formations comprise rotating a body of an earth-boring tool. Rotatable cutting elements rotatably connected to protruding journals at rotationally leading portions of blades, which extend from the body, are engaged with an earth formation. Cuttings are directed forward, away from cutting faces of the rotatable cutting elements, when the cuttings reach inner bores extending through the rotatable cutting elements. The rotatable cutting elements rotate around the protruding journals, each of which is at least partially located in an inner bore of one of the rotatable cutting elements.

BRIEF DESCRIPTION OF THE DRAWINGS

While the disclosure concludes with claims particularly pointing out and distinctly claiming embodiments of the invention, various features and advantages of embodiments of the disclosure may be more readily ascertained from the following description when read in conjunction with the accompanying drawings, in which:

DETAILED DESCRIPTION

The illustrations presented herein are not meant to be actual views of any particular earth-boring tool, rotatable cutting element, or component thereof, but are merely idealized representations employed to describe illustrative embodiments. Thus, the drawings are not necessarily to scale.

Disclosed embodiments relate generally to rotatable cutting elements for earth-boring tools that may rotate to present a continuously sharp cutting edge, occupy the same amount of space as fixed cutting elements, require fewer components, and better manage cuttings. More specifically, disclosed are embodiments of rotatable cutting elements that may include inner bores, which may be positioned around corresponding protruding journals at rotationally leading portions of blades to rotatably connect the rotatable cutting elements to the blade.

As used herein, the term "earth-boring tool" means and includes any type of bit or tool used for drilling during the formation or enlargement of a wellbore in an earth formation and includes, for example, rotary drill bits, percussion bits, core bits, eccentric bits, bicenter bits, reamers, expandable reamers, mills, drag bits, roller cone bits, hybrid bits, and other drilling bits and tools known in the art.

The term "polycrystalline material," as used herein, means and includes any material comprising a plurality of grains (i.e., crystals) of the material that are bonded directly together by intergranular bonds. The crystal structures of the individual grains of the material may be randomly oriented in space within the polycrystalline material.

As used herein, the term "intergranular bond" means and includes any direct atomic bond (e.g., ionic, covalent, metallic, etc.) between atoms in adjacent grains of material.

As used herein, the term "superhard" means and includes any material having a Knoop hardness value of about 3,000 $Kg_f/mm^2$ (29,420 MPa) or more. Superhard materials include, for example, diamond and cubic boron nitride. Superhard materials may also be characterized as "superabrasive" materials.

Figure 1:
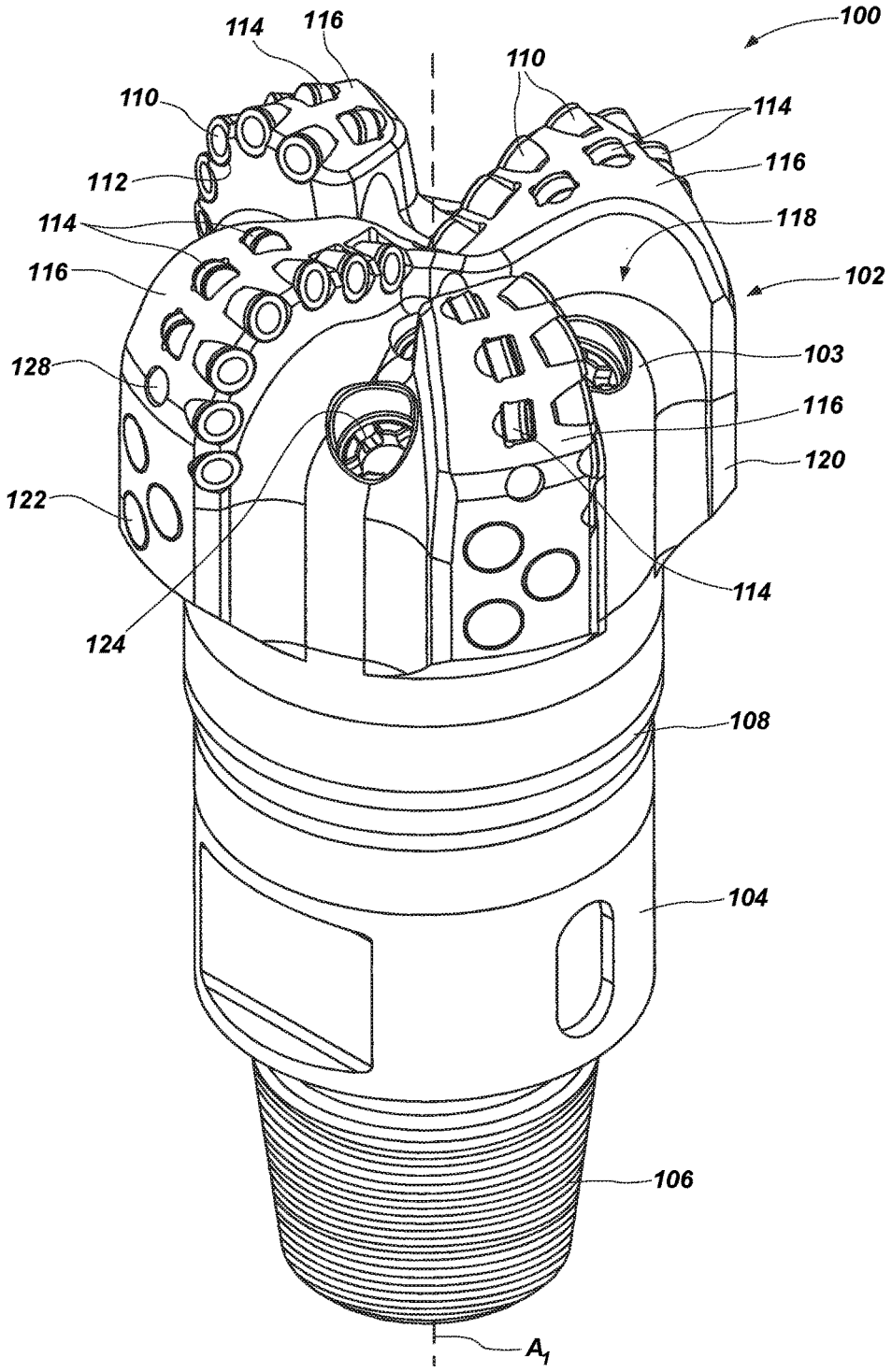
FIG. 1 is a perspective view of an earth-boring tool having rotatable cutting elements thereon.

Referring to FIG. 1, a perspective view of an earth-boring tool 100 is shown. The earth-boring tool 100 may include a body 102 secured to a shank 104 having a connection portion 106 (e.g., an American Petroleum Institute (API) threaded connection) configured to attach the earth-boring tool 100 to a drill string. In some embodiments, the body 102 may comprise a particle-matrix composite material, and may be secured to the shank 104 using an extension 108. In other embodiments, the body 102 may be secured to the shank 104 using a metal blank embedded within the particle-matrix composite body 102, or the body 102 may be secured directly to the shank 104. In other embodiments, the body 102 may be at least substantially formed from a steel alloy. The body 102 may include internal fluid passageways extending between a face 103 of the bit body 102 and a longitudinal bore, which extends through the shank 104, the extension 108, and partially through the body 102. Nozzle inserts 124 also may be provided at the face 103 of the bit body 102 within the internal fluid passageways.

The body 102 may further include blades 116 that are separated by junk slots 118 defined between the blades 116. Each blade 116 may extend from a location proximate an axis of rotation $A_1$ of the earth-boring tool 100 radially outward over the face 103 to a gage region 120, which may define a radially outermost portion of the body 102. Each blade 116 may also extend longitudinally away from a remainder of the body 102 and the back toward the body 102 to define a contoured cutting profile, which is described with more particularity in connection with FIG. 2. Rotatable cutting elements 110 may be rotatably connected to the body 102. In some embodiments, the rotatable cutting elements 110 may be located partially in pockets 112 that are located along rotationally leading portions of each of the blades 116 distributed over the face 103 of the drill bit 100. In other embodiments, the rotatable cutting elements 110 may not be located within pockets 112, but may protrude from the rotationally leading portions of each of the blades 116. The rotatable cutting elements 110 may be positioned to cut a subterranean earth formation being drilled while the earth-boring tool 100 is rotated under applied weight (e.g., weight-on-bit (WOB)) in a borehole about the axis of rotation $A_1$. In some embodiments, backup cutting elements 114, which may not be rotatable, may be secured to each blade 116 in a location rotationally trailing the rotatable cutting elements 110. In some embodiments, the earth-boring tool 100 may include gage wear plugs 122 and wear knots 128 secured to the body 102 in the gage region 120. In other embodiments, rotatable cutting elements 110 or fixed cutting elements 114 may be secured to the body 102 in the gage region 120.

Figure 2:
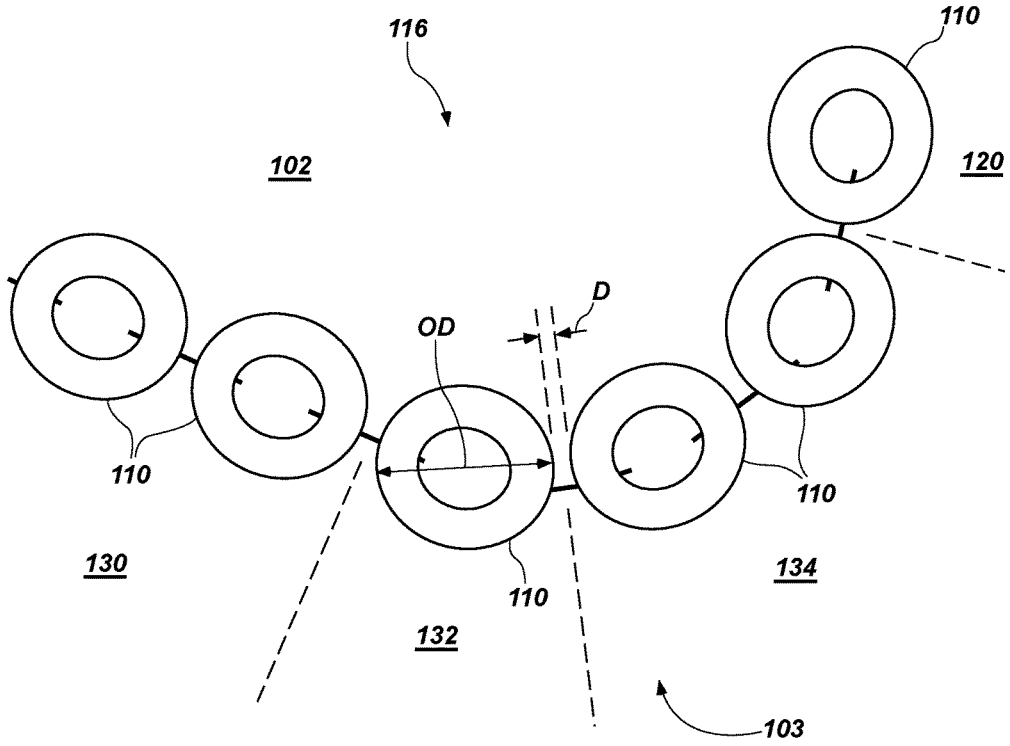
FIG. 2 is a simplified profile view of a blade of the earth-boring tool of FIG. 1 and illustrates rotatable cutting elements on the blades.

Referring to FIG. 2, a simplified profile view of a blade 116 of the earth-boring tool 100 of FIG. 1 is shown. The face 103 of the earth-boring tool 100 (see FIG. 1) may be divided into several regions 130, 132, 134, and 120 defined by the contour of each blade 116. For example, the face 103 may include a cone region 130 at a radially innermost position on the blade 116. The blade 116 may extend away from a remainder of the body 102, imparting to the cone region 120 a substantially conic shape. The face 103 may include a nose region 132 adjacent to and radially outward from the cone region 130. The blade 116 may continue to extend away from the remainder of the body 102, but the slope at which the blade 116 extends may gradually decrease within the nose region 132. The face 103 may include a shoulder region 134 adjacent to and radially outward from the nose region 132. The blade 116 may reach its apex within the shoulder region 134 and may begin to curve back toward the remainder of the body 102. Finally, the face 103 may include the gage region 120, which may be located adjacent to and radially outward from the shoulder region 134. The gage region 120 may define the radially outermost portion of the blade 116.

In some embodiments, rotatable cutting elements 110 may be located in one or more (e.g., each) of the regions 130, 132, 134, and 120 of the face 103. The specific positioning of the rotatable cutting elements 110 may vary from blade 116 to blade 116 and from earth-boring tool 100 to earth-boring tool. A shortest distance D between cutting edges 140 (see FIGS. 3 through 10) of adjacent rotatable cutting elements 110 may be at least substantially the same as the shortest distance between adjacent fixed cutting elements on a similarly configured blade 116. In other words, the rotatable cutting elements 110 may not require greater space between adjacent rotatable cutting elements 110 as compared to conventional fixed cutting elements, which may be located close to one another. For example, the shortest distance D between cutting edges 140 (see FIGS. 3 through 10) of adjacent rotatable cutting elements 110 may be between about 5% and about 50% of an outer diameter OD of the rotatable cutting elements 110. More specifically, the shortest distance D between cutting edges 140 (see FIGS. 3 through 10) of adjacent rotatable cutting elements 110 may be between about 10% and about 25% (e.g., about 15%) of the outer diameter OD of the rotatable cutting elements 110. In some embodiments, the shortest distance D between cutting edges 140 (see FIGS. 3 through 10) of adjacent rotatable cutting elements 110 may be about 0.5 in (1.27 cm) or less. More specifically, the shortest distance D between cutting edges 140 (see FIGS. 3 through 10) of adjacent rotatable cutting elements 110 may be about 0.25 in (0.64 cm) or less, such as, for example, about 0.1 in (0.25 cm) or less. As a specific, nonlimiting example, the shortest distance D between cutting edges 140 (see FIGS. 3 through 10) of adjacent rotatable cutting elements 110 may even be about 0.01 in (0.025 cm) or less.

Figure 3:
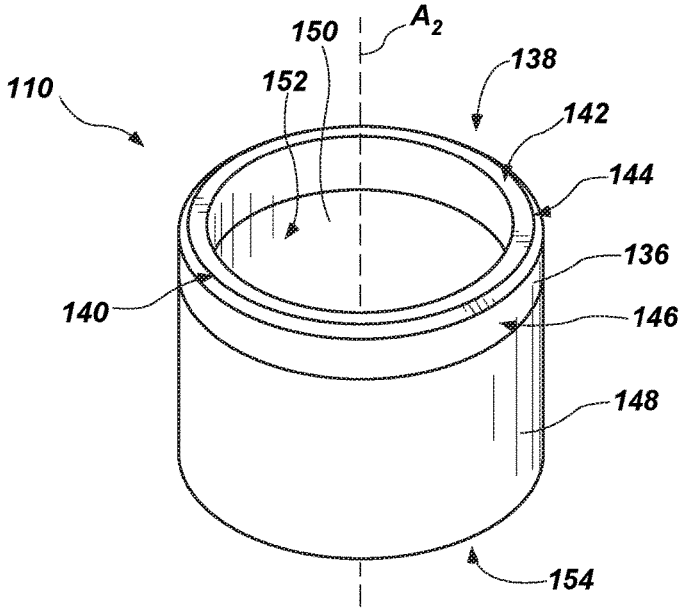
FIG. 3 is a perspective view of a rotatable cutting element configured to be rotatably connected to an earth-boring tool.
Figure 4:
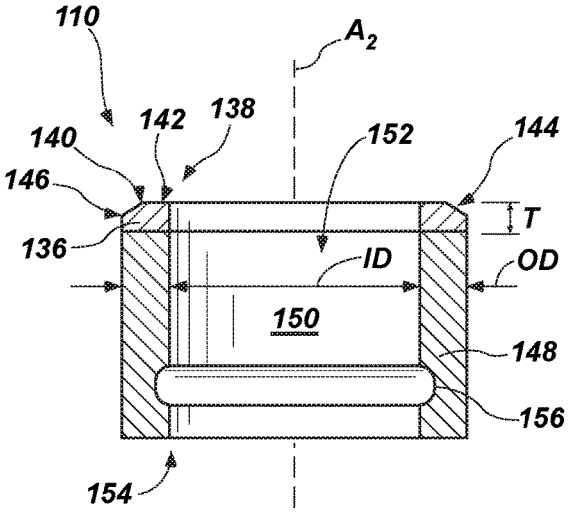
FIG. 4 is a cross-sectional side view of the rotatable cutting element of FIG. 3.
Figure 5:
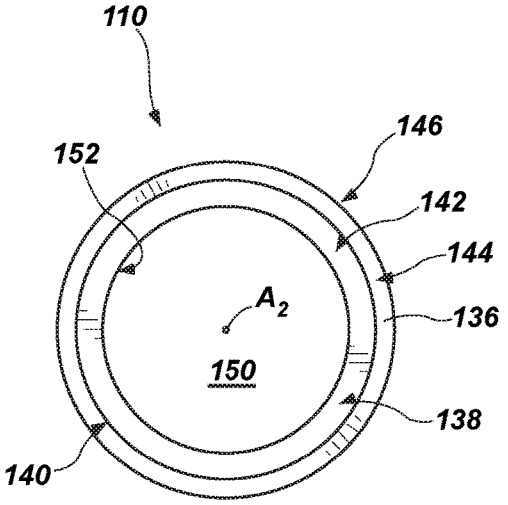
FIG. 5 is a front plan view of the rotatable cutting element of FIG. 3.
Figure 6:
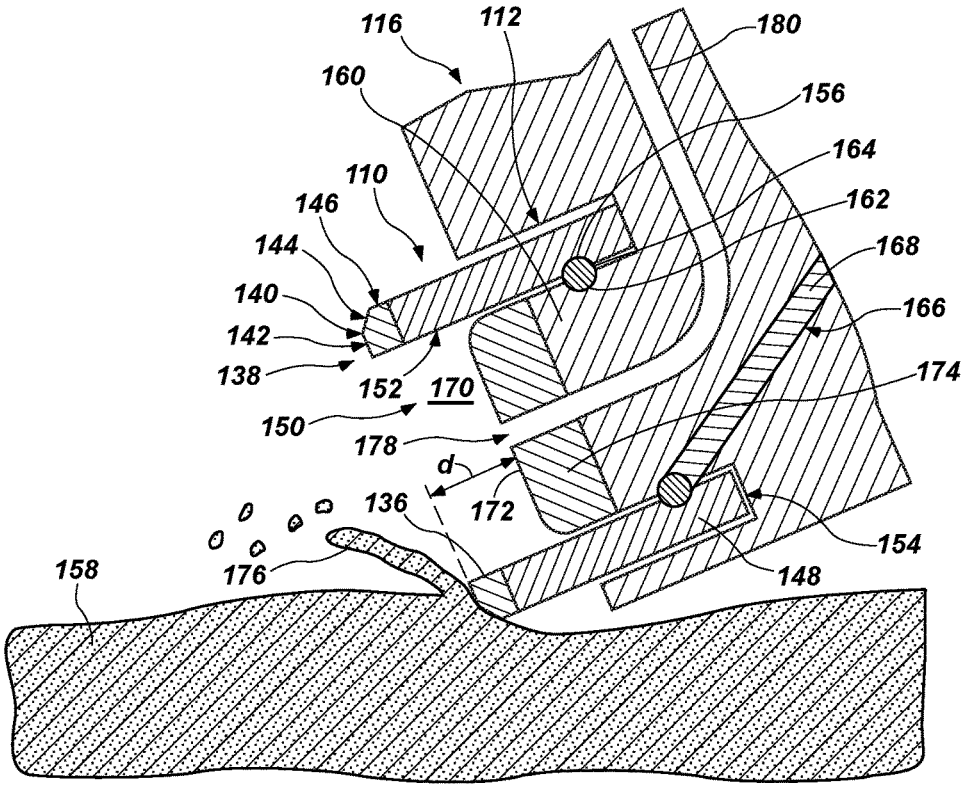
FIG. 6 is a simplified cross-sectional side view of the rotatable cutting element of FIG. 3 mounted on an earth-boring tool and engaging an earth formation.

Referring collectively to FIGS. 3 through 5, a perspective view, a cross-sectional view, and a front view of a rotatable cutting element 110 configured to be rotatably connected to an earth-boring tool 100 (see FIG. 1) are shown, respectively. The rotatable cutting element 110 may include a polycrystalline table 136 at a rotationally leading end 138 of the rotatable cutting element 110. The polycrystalline table 136 may be formed from a superhard polycrystalline material, such as, for example, polycrystalline diamond or polycrystalline cubic boron nitride. A thickness T of the polycrystalline table 136 may be, for example, between about 1.0 mm and about 5.0 mm. More specifically, the thickness T of the polycrystalline table 136 may be, for example, between about 1.8 mm and about 3.5 mm (e.g., 2.5 mm).

The polycrystalline table 136 may include a cutting edge 140 configured to directly engage with and remove material from an earth formation. The cutting edge 140 may be defined between an intersection between two surfaces, such as, for example, a cutting face 142 at a leading end of the polycrystalline table 136 and a chamfer 144 around a periphery of the polycrystalline table 136. The cutting face 142 may be oriented perpendicular to an axis of rotation $A_2$ of the rotatable cutting element 110, and the chamfer 144 may be oriented at an oblique angle with respect to the axis of rotation $A_2$. As another example, the cutting edge 140 may be defined between the cutting face 142 and an outer sidewall 146 of the polycrystalline table 136. The cutting edge 140 may extend entirely around the circumference of the polycrystalline table 136.

The polycrystalline table 136 may be attached to a substrate 148, which may be located at a trailing end 154 of the rotatable cutting element 110. The substrate 148 may be formed from a hard material suitable for use in a wellbore during an earth material removal process, such as, for example, a ceramic-metal composite (i.e., a "cermet") material (e.g., cobalt-cemented tungsten carbide). The polycrystalline table 136 may be secured to the substrate 148, for example, by catalyst material that may be located in interstitial spaces among individual grains of superhard material within the polycrystalline material and may be the matrix of the cermet material of the substrate 148. As another example, the polycrystalline table 136 may be brazed to the substrate 148.

An inner bore 150 may extend through the polycrystalline table 136 and the substrate 148 of the rotatable cutting element 110. The inner bore 150 may be defined, for example, by an inner sidewall 152. In some embodiments, the inner bore 150 may exhibit a cylindrical shape. In other embodiments, the inner bore 150 may exhibit a frustoconical shape, as discussed in greater detail in connection with FIG. 7. The inner bore 150 may impart to the rotatable cutting element 110 an annular cross-sectional shape. An inner diameter ID of the inner bore 150 may be, for example, between about 50% and about 90% of the outer diameter OD of the rotatable cutting element 110. More specifically, the inner diameter ID of the inner bore 150 may be, for example, between about 70% and about 80% (e.g., about 75%). A difference between the inner diameter ID and the outer diameter OD may be, for example, between about 1.5 mm and about 6.0 mm. More specifically, the difference between the inner diameter ID and the outer diameter OD may be, for example, between about 3 mm and about 4 mm (e.g., about 2.5 mm). The outer diameter OD of the rotatable cutting element 110 may be at least substantially the same as the outer diameter of a conventional fixed cutting element.

The rotatable cutting element 110 may include at least one outer ball race 156 extending around the inner sidewall 152 defining the inner bore 150. The outer ball race 156 may comprise, for example, a channel extending radially into the inner sidewall 152 of the substrate 148 and extending angularly around the inner sidewall 152. The outer ball race 156 may be configured to form a portion of a ball bearing, such as, for example, by receiving a portion of each ball 164 (see FIG. 6) of the ball bearing within the outer ball race 156. The outer ball race 156 may exhibit a substantially semicircular cross-sectional shape. In some embodiments, the rotatable cutting element 110 may include only a single outer ball race 156. In other embodiments, the rotatable cutting element 110 may include multiple outer ball races 156, as discussed in greater detail in connection with FIG. 7.

The rotatable cutting element 110 may be formed, for example, by positioning a blank (e.g., a ceramic or pressed sand structure in the shape of the inner bore 150) within a container. Particles of superhard material, which may be intermixed with particles of a catalyst material, may be positioned in the container around the blank. A preformed substrate 148 or substrate precursor materials (e.g., particles of tungsten carbide and powdered matrix material) may be positioned within the container around the blank and adjacent to the particles of superhard material. The container and its contents may be subjected to a high temperature/high pressure (HTHP) process, during which any catalyst material within the container may melt and infiltrate the particles of superhard material to catalyze formation of intergranular bonds among the particles of superhard material to form the polycrystalline table 136. The polycrystalline table 136 may also become attached to the substrate 148 by the catalyst material, which may be bonded with the matrix material of the substrate 148. Persons of ordinary skill in the art will recognize that other known processes in various combinations may be used to form the rotatable cutting element 110, such as, for example, sintering (e.g., HTHP sintering or lower temperature and pressure sintering), machining, polishing, grinding, and other known manufacturing processes for forming cutting elements for earth-boring tools Referring to FIG. 6, a simplified cross-sectional view of the rotatable cutting element 110 of FIG. 3 engaging an earth formation 158 is shown. The rotatable cutting element 110 may be rotatably connected to the blade 116 of an earth-boring tool 100 (see FIG. 1) at a rotationally leading portion of the blade 116. For example, a stationary, protruding journal 160 may extend from a remainder of the blade 116 (e.g., may be an integral, unitary portion of the material of the blade 116 or may be a separate, replaceable component affixed to the blade, such as, for example, by brazing or a threaded attachment) and may be at least partially positioned within the inner bore 150 of the rotatable cutting element 110. The protruding journal 160 may include at least one inner ball race 162 extending at least partially around (e.g., all the way around) a circumference of the protruding journal 160. The inner ball race 162 may be positioned to align with the outer ball race 156, and balls 164 may be retained between the inner ball race 162 and the outer ball race 156 to cooperatively form a ball bearing rotatably connecting the rotatable cutting element 110 to the protruding journal 160. The balls 164 may be inserted between the inner ball race 162 and the outer ball race 156 through a ball passage 166, which may be subsequently obstructed with a ball plug 168 to retain the balls 164 between the inner and outer ball races 162 and 156.

As the blade 116 rotates with the body 102 (see FIG. 1), the rotatable cutting element 110 may also revolve around the protruding journal 160 without requiring any driving mechanism (i.e., may exhibit passive rotation). For example, differences in tangential forces acting on the cutting edge 140 may inherently cause the rotatable cutting element 110 to rotate around the protruding journal 160. As the rotatable cutting element 110 rotates, new, less worn portions of the cutting edge 140 may engage with and remove the underlying earth material 158. In other embodiments, driving mechanisms may be used to induce the rotatable cutting element 110 to rotate (i.e., the rotatable cutting element 110 may exhibit active rotation). By using the entire cutting edge 140, the rotatable cutting element 110 may remain sharper and may have a longer useful life than a similarly configured fixed cutting element.

The protruding journal 160 may not extend beyond the cutting face 142 of the rotatable cutting element 110 in some embodiments. For example, a recess 170 may be defined by the inner bore 150 between the cutting face 142 of the rotatable cutting element 110 and a leading end 172 of the protruding journal 160. A depth d of the recess 170 may be, for example, between about 0.5 times and about 20 times the thickness T (see FIG. 4) of the polycrystalline table 136. More specifically, the depth d of the recess 170 may be, for example, between about 1.0 times and about 10 times the thickness T (see FIG. 4) of the polycrystalline table 136. As a specific, nonlimiting example, the depth d of the recess 170 may be between about 1.5 times and about 5.0 times (e.g., about 2.5 times) the thickness T (see FIG. 4) of the polycrystalline table 136. In other embodiments, the leading end 172 of the protruding journal 160 may be at least substantially flush (e.g., within about 0.1 in (0.25 cm) of being flush) with the cutting face 142 of the rotatable cutting element 110.

When cuttings 176 generated by scraping the cutting edge 140 along the earth formation 158 reach the recess 170, they may be propelled forward away from the cutting face 142. For example, the configuration of the rotatable cutting element 110 may cause the cuttings 176 to be propelled forward away from the cutting face 142 according to the cutting mechanisms disclosed in U.S. patent application Ser. No. 13/661,917, filed Oct. 26, 2012, now U.S. Pat. No. 9,303,461, issued Apr. 5, 2016, for "CUTTING ELEMENTS HAVING CURVED OR ANNULAR CONFIGURATIONS FOR EARTH-BORING TOOLS, EARTH-BORING TOOLS INCLUDING SUCH CUTTING ELEMENTS, AND RELATED METHODS," the disclosure of which is incorporated herein in its entirety by this reference. Briefly, the cuttings 176 may not have any surface to adhere to once the cuttings 176 reach the recess 170, which may inherently cause the cuttings 176 to be propelled forward away from the cutting face 142. By directing the cuttings 176 forward, away from the cutting face 142 of the rotatable cutting element 110, when the cuttings 176 reach the inner bore 150 of the rotatable cutting element 110, the rotatable cutting element 110 may reduce the likelihood that the cuttings 176 will adhere to and accumulate on features of the earth-boring tool 100 (see FIG. 1). In other words, cuttings 176 may be removed from the rotatable cutting element 110 more easily than from a rotatable cutting element lacking the inner bore 150 and the recess 170 defined by the inner bore 150 between the cutting face 142 and the leading end 172 of the protruding journal 160.

The leading end 172 of the protruding journal 160 may include a mass 174 of superhard polycrystalline material in some embodiments. For example, the mass 174 of superhard polycrystalline material may be formed in the same or similar processes to those described previously in connection with formation of the polycrystalline table 138. The mass 174 of superhard polycrystalline material may be attached to the remainder of the protruding journal 160, for example, by brazing. The mass 174 of superhard polycrystalline material may increase the durability of the protruding journal 160 in the event that some of the cuttings 176 enter the recess 170.

The leading end 172 of the protruding journal 160 may include a nozzle 178 configured to direct drilling fluid toward the cuttings 176 to break them up and carry them away, up an annulus defined between the drill string and the walls of the borehole. The nozzle 178 may comprise, for example, an opening at an end of a conduit 180 in fluid communication with the longitudinal bore extending through the drill string. The conduit 180 may extend from the longitudinal bore or from other fluid passageways within the body 102 (see FIG. 1), through the blade 116 and protruding journal 160, to the nozzle 178.

Figure 7:
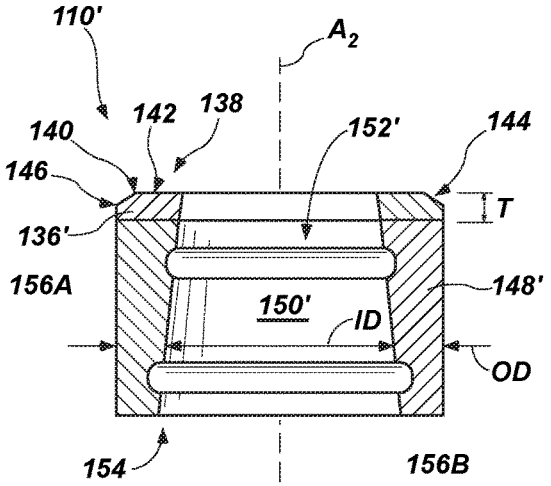
FIG. 7 is a cross-sectional side view of another embodiment of a rotatable cutting element configured to be rotatably connected to an earth-boring tool.

Referring to FIG. 7, a cross-sectional view of another embodiment of a rotatable cutting element 110' configured to be rotatably connected to an earth-boring tool 100 (see FIG. 1). The inner bore 150' of the rotatable cutting element 110' may be tapered. For example, the inner bore 150' of the rotatable cutting element 110' may exhibit a frustoconical shape. The inner diameter ID of the inner sidewall 152' defining the inner bore 150' may increase from the cutting face 142 of the polycrystalline table 136' to the trailing end 154 of the rotatable cutting element 110'. An included angle defined between the inner sidewall 152' defining the inner bore 150' and the axis of rotation $A_2$ of the rotatable cutting element 110' may be, for example, between about 5° and about 30°. More specifically, the included angle between the inner sidewall 152' and the axis of rotation $A_2$ may be, for example, between about 10° and about 20° (e.g., about 15°). The rotatable cutting element 110' may include multiple outer ball races 156A and 156B. The outer ball races 156A and 156B may extend entirely around the circumference of the inner sidewall 152'.

Figure 8:
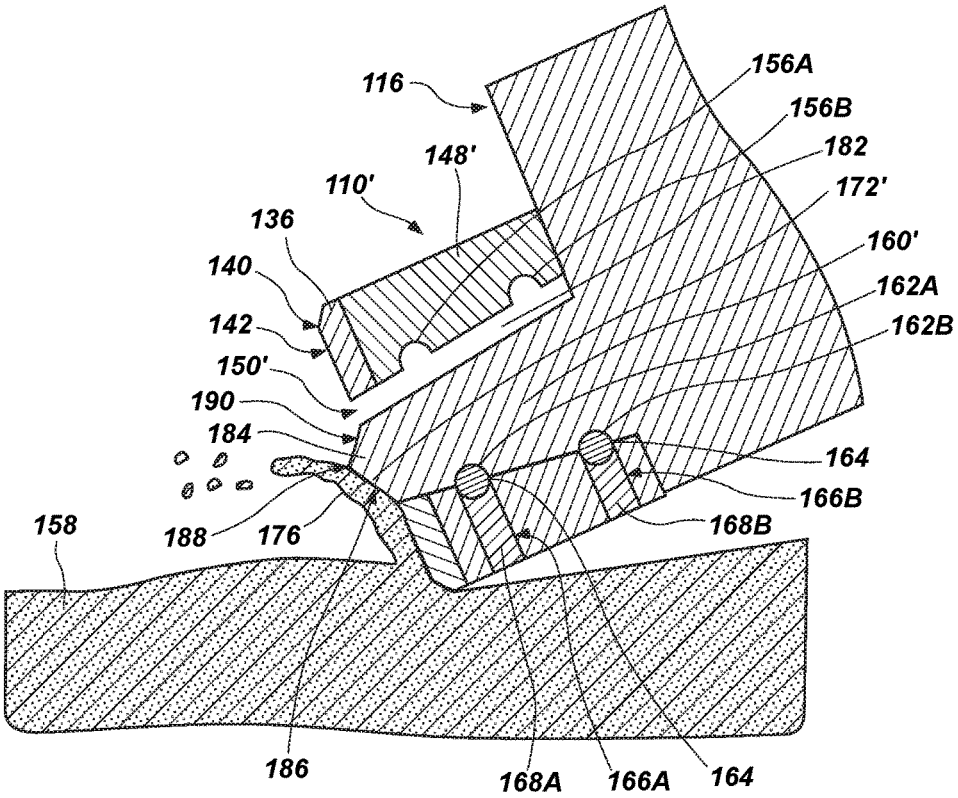
FIG. 8 is a simplified cross-sectional side view of the rotatable cutting element of FIG. 7 mounted on an earth-boring tool and engaging an earth formation.

Referring to FIG. 8, a simplified cross-sectional view of the rotatable cutting element 110' of FIG. 7 engaging an earth formation 158 is shown. The protruding journal 160' may include multiple inner ball races 162A and 162B extending at least partially around (e.g., only around a bottom portion of) a circumference of the protruding journal 160'. The inner ball races 162A and 162B may be positioned to align with the outer ball races 156A and 156B, and balls 164 may be retained between the inner ball races 162A and 162B and the outer ball races 156A and 156B to cooperatively form a ball bearing rotatably connecting the rotatable cutting element 110' to the protruding journal 160'. The balls 164 may be inserted between the inner ball races 162A and 162B and the outer ball races 156A and 156B through ball passages 166A and 166B, which may be subsequently obstructed with ball plugs 168A and 168B to retain the balls 164 between the inner and outer ball races 162A, 162B, 156A, and 156B.

The protruding journal 160' may be tapered in a manner similar to the taper of the inner bore 150'. For example, the protruding journal 160' may extend at the same angle as the inner bore 150'. In some embodiments, the protruding journal 160' may be asymmetrical. For example, the upper portion of the protruding journal 160' may be smaller than the lower portion, such that a clearance space 182 is defined between the upper portion of the protruding journal 160' and the sidewall 152' defining the inner bore 150' of the rotatable cutting element 110'. The rotatable cutting element 110' may run eccentric to the protruding journal 160', such that the rotatable cutting element 110' does not rotate about a central axis of the protruding journal 160', but bears against a lower side surface of the protruding journal 160'. The protruding journal 160' and the rotatable cutting element 110' may not be located within a pocket 112 (see FIG. 6) extending into the blade 116, but may protrude from a leading portion of the blade 116.

In some embodiments, the protruding journal 160' may extend beyond the cutting face 142 of the rotatable cutting element 110'. For example, the protruding journal 160' may include a chip breaker 184 at the leading end 172' of the protruding journal 160', which may be protrude from the cutting face 142 of the rotatable cutting element 110'. The chip breaker 184 may be defined by, for example, a lower surface 186 extending away from the cutting face 142 to an apex 188 (e.g., may be arcuate, angled, etc.) and an upper surface 190 extending back toward the cutting face 142 from the apex 188.

When cuttings 176 generated by scraping the cutting edge 140 along the earth formation 158 reach the chip breaker 184, they may be propelled forward away from the cutting face 142. By directing the cuttings 176 forward, away from the cutting face 142 of the rotatable cutting element 110', when the cuttings 176 reach the chip breaker 184, the chip breaker 184 may reduce the likelihood that the cuttings 176 will adhere to and accumulate on features of the earth-boring tool 100 (see FIG. 1). In other words, the chip breaker 184 may completely remove cuttings 176 more easily than a rotatable cutting element lacking a chip breaker 184 protruding from an inner bore 150 of the rotatable cutting element.

Figure 9:
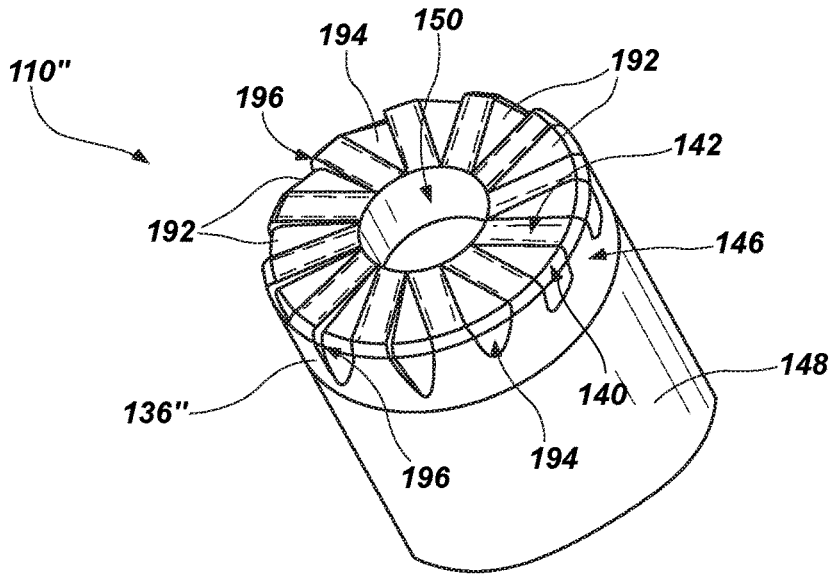
FIG. 9 is a perspective view of another embodiment of a rotatable cutting element including facets configured to induce rotation.

Referring to FIG. 9, a perspective view of another embodiment of a rotatable cutting element 110" including facets 192 configured to induce rotation is shown. The facets 192 may comprise, for example, sawtooth or wave-shaped recesses extending from the cutting face 142, the outer sidewall 146, or both into the polycrystalline table 136". In some embodiments, the facets 192 may be defined by a sloping surface 194 extending from the cutting face 142, the outer sidewall 146, or both into the polycrystalline table 136" and a transition surface 196 extending abruptly back to the cutting face 142. When the rotatable cutting element 110" engages with an earth formation 158 (see FIGS. 6, 8), the forces acting on the facets 192, and particularly on the transition surface 196, may induce the rotatable cutting element 110" to rotate.

Figure 10:
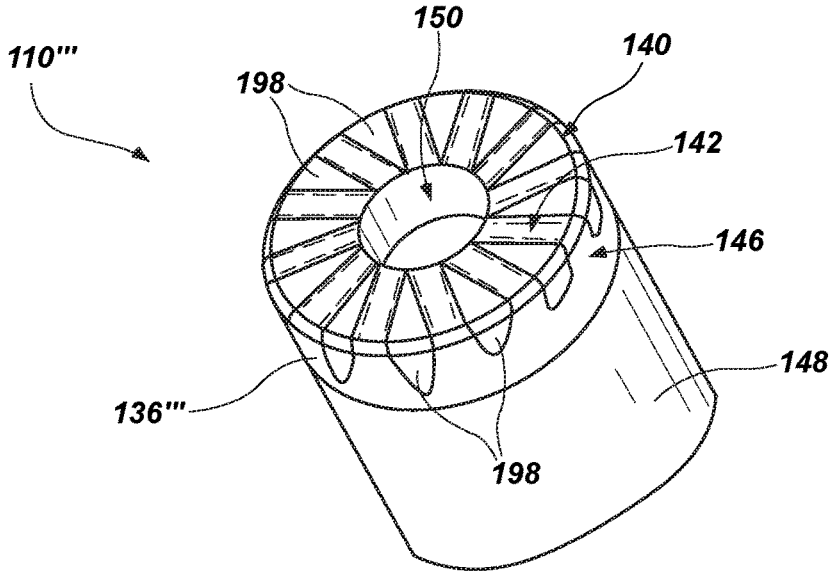
FIG. 10 is a perspective view of another embodiment of a rotatable cutting element including differently polished regions configured to induce rotation.

Referring to FIG. 10, a perspective view of another embodiment of a rotatable cutting element 110"' including differently polished regions 198 configured to induce rotation is shown. The differently polished regions 198 may comprise, for example, sawtooth or wave-shaped rougher regions located on the cutting face 142, the outer sidewall 146, or both. In some embodiments, the differently polished regions 198 may be defined by regions of the cutting face 142, the outer sidewall 146, or both that have been deliberately made rougher (e.g., by grinding or by polishing to a lesser extent) than a remainder of the cutting face 142, the outer sidewall 146, or both. In some embodiments, the differently polished regions 198 may exhibit a gradient in roughness such that a rotationally trailing portion of each differently polished region 198 exhibits a greater surface roughness than a rotationally leading portion of each differently polished region 198. When the rotatable cutting element 110"' engages with an earth formation 158 (see FIGS. 6, 8), the forces acting on the differently polished regions 198 may induce the rotatable cutting element 110"' to rotate.

Additional, nonlimiting embodiments within the scope of this disclosure include the following:

Embodiment 1

A rotatable cutting element for an earth-boring tool comprises a substrate. A polycrystalline table is attached to the substrate. The polycrystalline table is located on an end of the substrate. An inner bore extends through the substrate and the polycrystalline table. An inner diameter of the inner bore increases from a cutting face of the polycrystalline table to a trailing end of the substrate.

Embodiment 2

The rotatable cutting element of Embodiment 1, further comprising an outer ball race extending around a sidewall defining the inner bore.

Embodiment 3

An earth-boring tool comprises a body comprising blades extending radially outward to define a face at a leading end of the body. Each blade comprises protruding journals at a rotationally leading end of each blade. Rotatable cutting elements are rotatably connected to the protruding journals. One of the rotatable cutting elements comprises a substrate. A polycrystalline table is attached to the substrate. The polycrystalline table is located on an end of the substrate. An inner bore extends through the substrate and the polycrystalline table. One of the protruding journals is at least partially located within the inner bore. A rotationally leading end of the one of the protruding journals does not extend beyond a cutting face.

Embodiment 4

The earth-boring tool of Embodiment 3, wherein a recess is defined by the inner bore between the cutting face of the polycrystalline table and the rotationally leading end of the one of the protruding journals and a depth of the recess is between 1.0 times and about 10 times a thickness of the polycrystalline table.

Embodiment 5

The earth-boring tool of Embodiment 3 or Embodiment 4, wherein a shortest distance between cutting edges of adjacent rotatable cutting elements is about 0.25 in (0.64 cm) or less.

Embodiment 6

The earth-boring tool of any one of Embodiments 3 through 5, wherein the leading end of the one of the protruding journals comprises a superhard polycrystalline material.

Embodiment 7

The earth-boring tool of any one of Embodiments 3 through 6, wherein the leading end of the one of the protruding journals comprises a nozzle in fluid communication with a conduit configured to conduct fluid to the nozzle.

Embodiment 8

The earth-boring tool of any one of Embodiments 3 through 7, wherein the substrate comprises an outer ball race extending around a sidewall defining the inner bore, the one of the protruding journals comprises a corresponding inner ball race extending at least partially around a circumference of the one of the protruding journals, and balls are positioned between the outer ball race and the inner ball race to rotatably connect the one of the rotatable cutting elements to the one of the protruding journals.

Embodiment 9

The earth-boring tool of Embodiment 8, wherein the inner ball race extends entirely around the circumference of the one of the protruding journals.

Embodiment 10

The earth-boring tool of any one of Embodiments 3 through 9, wherein the one of the rotatable cutting elements and the one of the protruding journals to which it is rotatably connected are located at least partially within a pocket extending into the blade.

Embodiment 11

The earth-boring tool of any one of Embodiments 3 through 10, further comprising a fixed backup cutting element secured to one of the blades rotationally following one of the rotatable cutting elements.

Embodiment 12

An earth-boring tool comprises a body comprising blades extending radially outward to define a face at a leading end of the body. Each blade comprises protruding journals at a rotationally leading end of each blade. Rotatable cutting elements are rotatably connected to the protruding journals. One of the rotatable cutting elements comprises a substrate. A polycrystalline table is attached to the substrate. The polycrystalline table is located on an end of the substrate. An inner bore extends through the substrate and the polycrystalline table. One of the protruding journals is at least partially located within the inner bore. The one of the protruding journals comprises a chip breaker protruding from a cutting face of the polycrystalline table.

Embodiment 13

The earth-boring tool of Embodiment 12, wherein a shortest distance between cutting edges of adjacent rotatable cutting elements is about 0.25 in (0.64 cm) or less.

Embodiment 14

The earth-boring tool of Embodiment 12 or Embodiment 13, wherein the chip breaker is defined by a lower surface extending away from the cutting face to an apex and an upper surface extending back toward the cutting face from the apex.

Embodiment 15

The earth-boring tool of any one of Embodiments 12 through 14, wherein an inner diameter of the inner bore increases from a cutting face of the polycrystalline table to a trailing end of the substrate.

Embodiment 16

The earth-boring tool of any one of Embodiments 12 through 15, wherein the substrate comprises outer ball races extending around a sidewall defining the inner bore, the one of the protruding journals comprises corresponding inner ball races extending at least partially around a circumference of the one of the protruding journals, and balls are positioned between the outer ball races and the inner ball races to rotatably connect the one of the rotatable cutting elements to the one of the protruding journals.

Embodiment 17

The earth-boring tool of Embodiment 16, wherein the inner ball races extend partially around the circumference of the one of the protruding journals and a clearance space is defined between the one of the rotatable cutting elements and the one of the protruding journals around a remainder of the circumference of the one of the protruding journals.

Embodiment 18

The earth-boring tool of any one of Embodiments 12 through 17, wherein the one cutting element is not located within a pocket extending into the blade.

Embodiment 19

A method of removing an earth formation comprises rotating a body of an earth-boring tool. A rotatable cutting element rotatably connected to a protruding journal at a rotationally leading portion of a blade, which extends from the body, is engaged with an earth formation. Cuttings are directed forward, away from a cutting face of the rotatable cutting element, when the cuttings reach an inner bore extending through the rotatable cutting element. The rotatable cutting element rotates around the protruding journal, which is at least partially located in the inner bore of the rotatable cutting element.

Embodiment 20

The method of Embodiment 19, wherein the protruding journal comprises a chip breaker protruding from the cutting face of the rotatable cutting element and wherein directing the cuttings forward away from the cutting face of the rotatable cutting element comprises using the chip breaker to direct the cuttings forward away from the cutting face of the rotatable cutting element.

Embodiment 21

The method of Embodiment 19, wherein a recess is defined between the cutting face of the rotatable cutting element and a leading end of the protruding journal and wherein directing the cuttings forward away from the cutting face of the rotatable cutting element comprises directing cuttings forward away from the cutting face of the rotatable cutting element when the cuttings reach the recess.

Embodiment 22

The method of any one of Embodiments 19 through 21, wherein rotating the cutting element around the protruding journal comprises rotating the cutting element on balls located between an outer ball race extending around a sidewall of the inner bore of the cutting element and an inner ball race extending partially around a circumference of the protruding journal at least partially located in the inner bore, there being a clearance space defined between the rotatable cutting element and the protruding journal around a remainder of the circumference of the protruding journal.

Embodiment 23

The method of any one of Embodiments 19 through 22, wherein rotating the rotatable cutting element around the protruding journal comprises rotating the rotatable cutting element at least partially within a pocket extending into the rotationally leading portion of the blade.

Embodiment 24

The method of any one of Embodiments 19 through 23, further comprising bearing on the protruding journal at least a portion of an axial load acting on the rotatable cutting element by contacting a sidewall defining the inner bore against an outer surface of the protruding journal, wherein an inner diameter of the inner bore increases from a cutting face of the cutting element to a trailing end of the cutting element.

Embodiment 25

An earth-boring tool combining any of the features described in Embodiments 3 through 18 that may logically be combined with one another.

While certain illustrative embodiments have been described in connection with the figures, those of ordinary skill in the art will recognize and appreciate that the scope of the disclosure is not limited to those embodiments explicitly shown and described herein. Rather, many additions, deletions, and modifications to the embodiments described herein may be made to produce embodiments within the scope of the disclosure, such as those hereinafter claimed, including legal equivalents. In addition, features from one disclosed embodiment may be combined with features of another disclosed embodiment while still being within the scope of the disclosure, as contemplated by the inventors.

What is claimed is:

1. An earth-boring tool, comprising:

a body comprising blades extending radially proximate a leading end of the body, at least one of the blades comprising at least one protruding journal proximate a rotationally leading surface of the at least one of the blades; and a rotatable cutting element rotatable about the at least one protruding journal, the rotatable cutting element comprising:

a substrate;

a polycrystalline table secured to an end of the substrate; and an inner bore extending through the substrate and the polycrystalline table, the at least one protruding journal located at least partially within the inner bore, wherein a rotationally leading surface of the at least one protruding journal rotationally trails a cutting face of the polycrystalline table.

2. The earth-boring tool of claim 1, wherein a recess is defined by the inner bore between the cutting face of the polycrystalline table and the rotationally leading surface of the at least one protruding journal and a depth of the recess is between about 1.0 times and about 10 times a thickness of the polycrystalline table.

3. The earth-boring tool of claim 1, wherein the rotationally leading surface of the at least one protruding journal comprises a superhard polycrystalline material.

4. The earth-boring tool of claim 1, wherein the rotationally leading surface of the at least one protruding journal comprises a nozzle in fluid communication with a conduit configured to conduct fluid to the nozzle.

5. The earth-boring tool of claim 1, wherein the substrate comprises an outer ball race extending around a sidewall defining the inner bore, the at least one protruding journal comprises a corresponding inner ball race extending at least partially around a circumference of the at least one protruding journal, and balls are positioned between the outer ball race and the inner ball race to rotatably connect the rotatable cutting element to the at least one protruding journal.

6. The earth-boring tool of claim 5, wherein the inner ball race extends entirely around the circumference of the at least one protruding journal.

7. The earth-boring tool of claim 1, wherein the rotatable cutting element and the at least one protruding journal to which it is rotatably connected are located at least partially within a pocket extending into the at least one of the blades.

8. The earth-boring tool of claim 1, wherein the rotatable cutting element and the at least one protruding journal to which it is rotatably connected are not located within a pocket extending into the at least one of the blades.

9. The earth-boring tool of claim 1, further comprising a fixed backup cutting element secured to the at least one of the blades rotationally following the rotatable cutting element.

10. The earth-boring tool of claim 1, wherein an inner diameter of the inner bore is between about 50% and about 90% of an outer diameter of the rotatable cutting element.

11. The earth-boring tool of claim 1, wherein a sidewall of the rotatable cutting element at least partially defining the inner bore is tapered.

12. The earth-boring tool of claim 11, wherein the inner bore exhibits an at least substantially frustoconical shape.

13. The earth-boring tool of claim 11, wherein an inner diameter of the sidewall defining the inner bore increases from the cutting face to a trailing end of the rotatable cutting element.

14. The earth-boring tool of claim 13, wherein an included angle defined between the sidewall defining the inner bore and an axis of rotation of the rotatable cutting element is between about 5° and about 30°.

15. The earth-boring tool of claim 1, wherein the cutting face comprises facets shaped and positioned to induce rotation of the rotatable cutting element upon engagement with an earth formation, the facets extending from the cutting face into the polycrystalline table.

16. The earth-boring tool of claim 1, wherein the cutting face comprises polished regions shaped and positioned to induce rotation of the rotatable cutting element upon engagement with an earth formation, the polished regions exhibiting higher surface roughness values when compared to adjacent regions of the cutting face.

17. A method of removing an earth formation, comprising:

rotating a body of an earth-boring tool;

engaging a rotatable cutting element with an earth formation, wherein the rotatable cutting element is rotatable about a protruding journal proximate a rotationally leading surface of a blade extending from the body;

disengaging cuttings from contact with a cutting face of the rotatable cutting element when the cuttings reach an inner bore extending through the rotatable cutting element; and rotating the rotatable cutting element around the protruding journal responsive to the engagement of the rotatable cutting element with the earth formation, the protruding journal located at least partially in the inner bore of the rotatable cutting element, a rotationally leading surface of the protruding journal rotationally trailing the cutting face of the rotatable cutting element.

18. The method of claim 17, wherein disengaging the cuttings from contact with the cutting face of the rotatable cutting element when the cuttings reach the inner bore extending through the rotatable cutting element comprises directing the cuttings forward, away from the cutting face of the rotatable cutting element when the cuttings reach the inner bore.

19. The method of claim 17, wherein the rotatable cutting element comprises a substrate and a polycrystalline table secured to an end of the substrate and wherein disengaging the cuttings from contact with the cutting face of the rotatable cutting element when the cuttings reach the inner bore extending through the rotatable cutting element comprises disengaging the cuttings from contact with the cutting face of the rotatable cutting element when the cuttings reach a recess defined by the inner bore between the cutting face and the rotationally leading surface of the protruding journal, a depth of the recess being between about 1.0 times and about 10 times a thickness of the polycrystalline table of the rotatable cutting element.

20. The method of claim 17, further comprising bearing at least a portion of an axial load acting on the rotatable cutting element by contacting a sidewall of the rotatable cutting element defining the inner bore against an outer surface of the protruding journal, wherein an inner diameter of the inner bore increases from the cutting face of the rotatable cutting element to a trailing end of the rotatable cutting element.

* * * * *